United States Patent [19]

Takano et al.

[11] Patent Number: 4,519,323

[45] Date of Patent: May 28, 1985

[54] VELOCITY CONTROLLING APPARATUS AND METHOD TO BE USED WITH A STOKER TYPE BURNING APPARATUS

[75] Inventors: Osamu Takano, Suita; Koji Fujiwara, Yamatokooriyama, both of Japan

[73] Assignee: Kabushiki Kaisha Takuma, Osaka, Japan

[21] Appl. No.: 593,079

[22] Filed: Mar. 26, 1984

[30] Foreign Application Priority Data

Apr. 1, 1983 [JP] Japan ..... 58-58199

[51] Int. Cl.[3] ..... F23H 7/08

[52] U.S. Cl. ..... 110/281; 110/191; 110/192; 110/268; 110/186

[58] Field of Search ..... 110/268, 281, 291, 186, 110/191, 192; 126/174, 175

[56] References Cited

U.S. PATENT DOCUMENTS

| | | | |
|---|---|---|---|
| 1,240,614 | 9/1917 | Sprague | 110/191 |
| 1,438,190 | 12/1922 | Skelby | 110/281 |
| 1,644,953 | 10/1927 | Seyboth | 110/281 |
| 1,840,374 | 1/1932 | Thacher, Jr. | 110/268 |
| 2,932,264 | 4/1960 | Hurst | 110/192 |
| 3,585,947 | 6/1971 | Dvirka | 110/186 |
| 4,239,029 | 12/1980 | Martin et al. | 110/268 |
| 4,385,567 | 5/1983 | Voss | 110/186 |
| 4,471,074 | 9/1984 | John et al. | 110/281 |

*Primary Examiner*—Henry C. Yuen

*Attorney, Agent, or Firm*—Griffin, Branigan, & Butler

[57] ABSTRACT

The present invention relates to a velocity controlling apparatus and method to be used with a stoker type burning apparatus on a refuse incinerator which moves refuse successively by reciprocating motion of movable fire grates. The movable fire grates, which repeat reciprocating motion in a cycle of forward movement from a backward end, backward movement from a forward end and a stop at the backward end, is so controlled that the total of time Tf of the forward movement, time Tb of the backward movement, and time Ts of the resting at the backward end equals a standard cycle time Tc calculated on the basis of a predetermined frequency N (N/min.) of the reciprocating motion of the movable fire grates.

1 Claim, 5 Drawing Figures

VELOCITY CONTROLLING APPARATUS AND METHOD TO BE USED WITH A STOKER TYPE BURNING APPARATUS

BACKGROUND OF THE INVENTION

The present invention relates to a velocity controlling apparatus and method to be used with a stoker type burning apparatus on an incinerator for burning refuse such as domestic refuse, industrial refuse and the like (hereinafter called simply "refuse").

A known stoker type burning apparatus on a refuse incinerator comprises a drying stoker 3, a first combustion stoker 4 and a second combustion stoker 5 which are arranged to form stairs, as shown in FIG. 1. Each of the drying, first combustion and second combustion stokers 3, 4, and 5 is formed by a combination of movable fire grates and fixed fire grates, with the movable fire grates reciprocating back and forth at a predetermined velocity. A driving apparatus such as a hydraulic cylinder 8 activates a link mechanism 21 to give a reciprocating motion to movable fire grates 20, thereby imparting progressive movement to refuse deposited on the stokers to convey the same forward.

Consequently, the flow speed at which the refuse to be burned is conveyed by the reciprocating motion of the movable fire grates is nearly directly proportional to the speed of the reciprocating motion of the movable fire grates 20, i.e. the frequency of the reciprocating motion, that is, the number of cycles of the movable fire grates 20 measured in a unit length of time.

Refuse 2 fed into the refuse incinerator through a hopper 1 is placed successively on the drying stoker 3 and is dried thereon. The refuse thus dried is passed on to the first combustion stoker 4 for combustion and conveyed to the second combustion stoker 5 for complete combustion. Carbon left as residue is completely burned on the second combustion stoker 5, thereby turning the refuse into ash containing no combustibles, which is then taken out of the incinerator.

The refuse thrown into the incinerator varies day to day in kind of contents and in its humidity (hereinafter called "quality of the refuse"). Consequently, in order to completely burn the refuse as stated above, it is necessary to adjust the drying time, the combustion time and the time for burning carbon left unburned as residue, in accordance with the said quality of the refuse.

A known incinerator is adjusted by controlling the flow speed of the refuse conveyed on the stokers, that is, controlling how long the refuse remains on the drying, first combustion and second stokers 3, 4, and 5.

FIGS. 2 and 3 show an example of a method for regulating the speed of refuse flowing on the stokers in which the working speed of the hydraulic cylinder 8 is regulated by employing a variable-speed pump 6 as a hydraulic source or by controlling the amount of oil supplied with a flux control valve 7 on a fluid pipe. That is, frequency of the reciprocating motion of the movable fire grates as measured in a unit length of time is changed by controlling the working speed of the hydraulic cylinder 8, thereby regulating the length of time in which the refuse is on the stoker. Reference numbers 9, 10, and 11 (FIGS. 2 and 3) indicate a hydraulic pump, a leak valve and an electromagnetic valve, respectively.

But, the above stated methods in which the working speed of the hydraulic cylinder 8 is controlled by regulating the pumping capacity of the variable-speed pump 6 or by regulating the flux of fluid (quantity of fluid supplied) with a flux controlling valve 7 have the problem that fluid supplied to the hydraulic cylinder 8 continuously decreases because of increased leakage of fluid inside the hydraulic apparatus, referred to as "time wear", which occurs in connection with hydraulic control. The result is that a stabilized, constant, working speed of the hydraulic cylinder cannot be obtained.

Further, even if the quantity of fluid supplied to the hydraulic cylinder 8 is precise and stable, the problem with stabilization of speed of the reciprocating motion of the stokers remains unsolved since it is impossible to stop an increase of fluid leakage in the cylinder 8 caused by time abrasion of the cylinder piston of the cylinder 8 with the result that change of hydraulic load results in change of speed of the reciprocating motion of the stokers.

SUMMARY OF THE INVENTION

The present invention seeks to solve the aforementioned problems relating to regulation of speed of reciprocating motion of movable fire grates in conventional refuse incinerators. It is, therefore, a primary object of the present invention to provide an apparatus and method for regulating the speed of fire grates of stoker type burning apparatus on refuse incinerators which can regulate and stabilize the flowing speeds of refuse to be burned and, therefore, can burn it completely, even if hydraulic operation performance incurs some "time wear" resulting from deterioration of efficiency of hydraulic apparatus. The inventors noted that the velocity V of forward movement of refuse on stokers is directly proportional to frequency N, as measured in a unit length of time, of the reciprocating motion of the movable fire grates.

Consequently, the present invention is, in principle, so structured that the frequency of the reciprocating motion of the movable fire grates is controlled to equal the predetermined number N of cycles measured in a unit length of time which is required to achieve a predetermined velocity V of forward movement of refuse to be burned, with the speed of the reciprocating movement of the movable fire grates not being controlled.

That is, the present invention relates to a stoker reciprocating to sequentially move refuse forward wherein movable fire grates repeatedly reciprocate back and forth in a cycle comprising reciprocating movement between a forward end B, a backward end A and a stop (rest) for a predetermined time at the backward end A, and wherein further that the stop time Ts is so controlled that the total of time Tf necessary for the forward movement of the movable fire grates, time Tb for the backward movement and time Ts for the stop (rest) of the same equals a predetermined cycle time Tc measured on the basis of the frequency N of the reciprocating motion of the movable fire grates, which frequency N is necessary to impart a predetermined low velocity V of the refuse.

Even if the speed of the forward and backward movement of the movable fire grates changes because of outside effects such as "time wear" of hydraulic performance, hydraulic load change and the like, the present invention, as structured above, can erase the effects of a change of the speed of movement of the movable fire grates, thereby providing a stabilized flow speed of refuse to be burned.

DETAILED DESCRIPTION OF THE INVENTION

Figure 1:
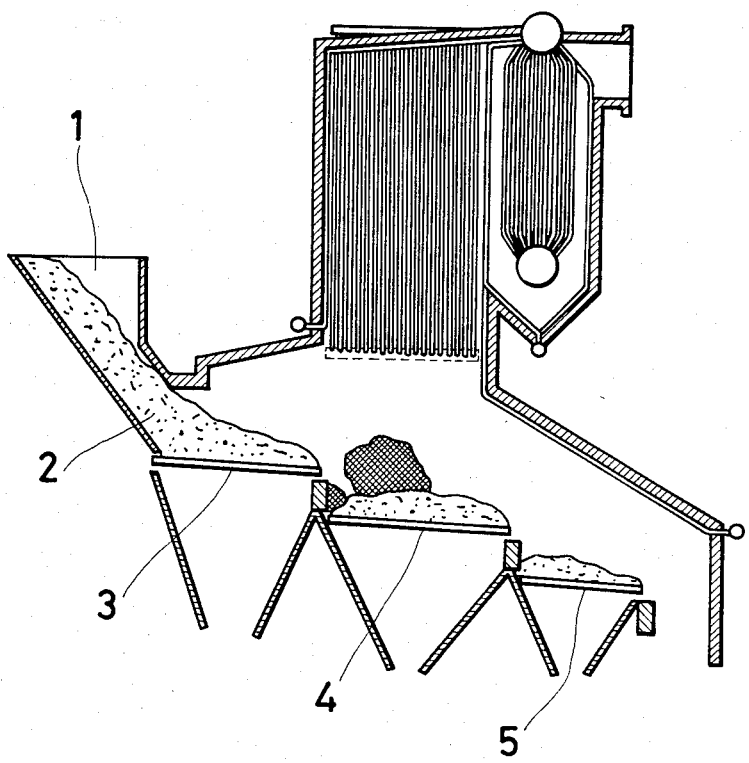
FIG. 1 is a rough sketch of a sectional view of a refuse incinerator having a stoker type burning apparatus.
Figure 3:
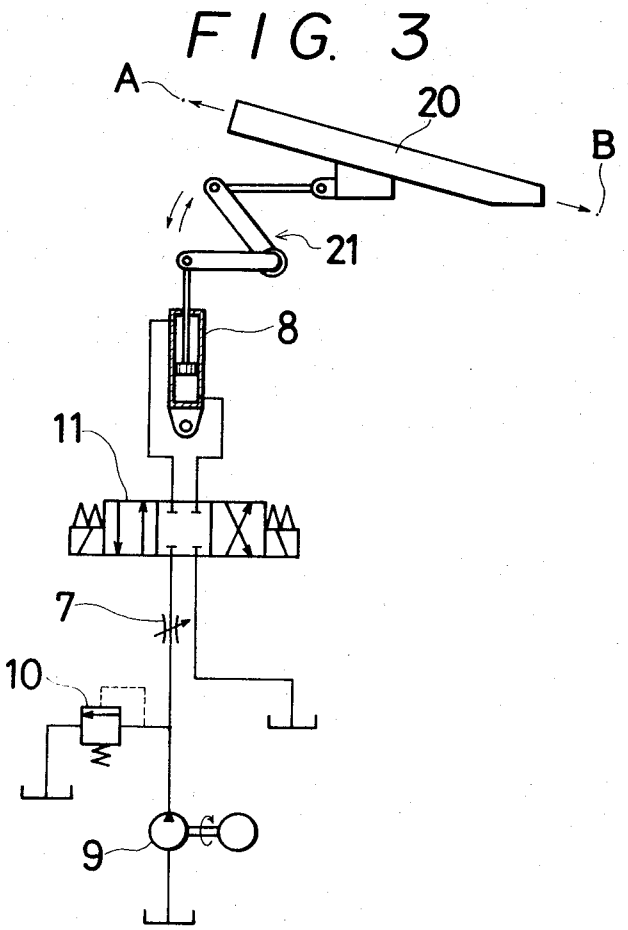
FIGS. 2 and 3 are hydraulic flow charts of driving apparatus activating movable fire grates of the stoker type burning apparatus of FIG. 1.
Figure 2:
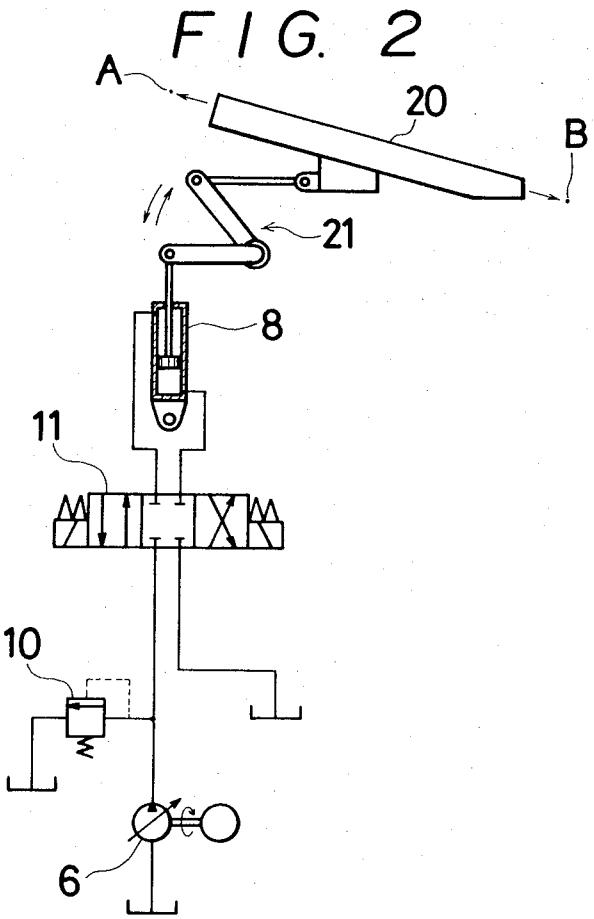

The present invention is explained below with reference to FIGS. 2 and 5.

Figure 4:
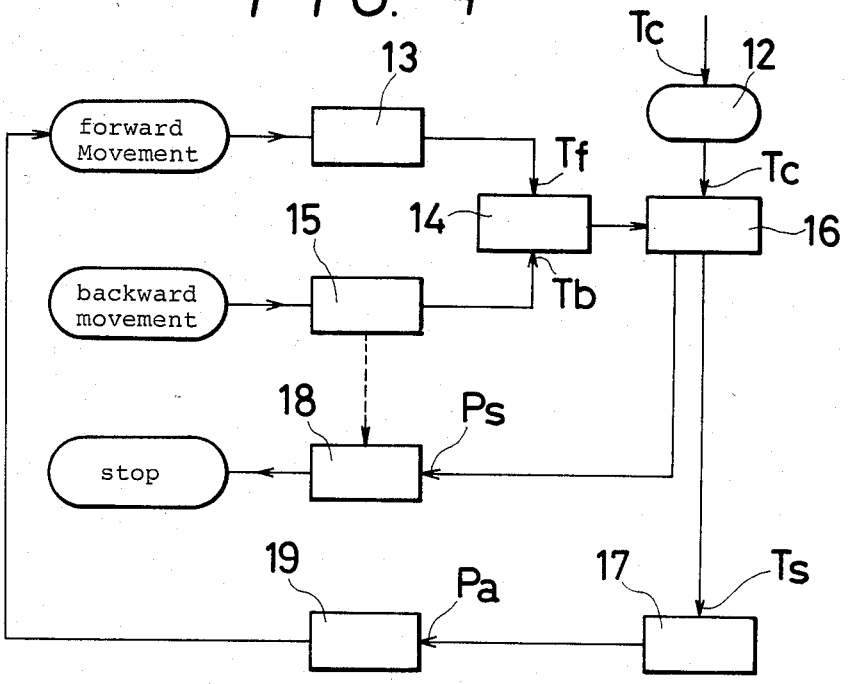
FIG. 4 is a block diagram showing a speed-regulating apparatus and a speed regulating method of the invention to be used with stoker type burning apparatus; and, FIG. 5 is a time chart showing operation of movable fire grates according to the present invention.

A velocity controlling apparatus on stoker type burning apparatus according to the present invention comprises, as shown in FIG. 4:

- a time counter 13 which measures time Tf needed for movable fire grates 20 to move from a rearward, or backward, end A to a forward end B;
- a time counter 15 which measures time Tb needed for the movable fire grates 20 to move from the forward end B to the backward end A;
- a fire grate's stopping apparatus 18 which stops the movable fire grates 20 when the fire grates 20 reach the backward end A;
- a time adding machine 14 which adds up time Tf and time Tb;
- a standard-speed setting apparatus 12 which provides a standard cycle Tc, where $Tc=1/N$ (min.), needed for the movable fire grates 20 to finish a cycle of reciprocating motion, the number N being representative of frequency of the reciprocating motion of the movable fire grates 20 and being predetermined in accordance with the quality of the refuse;
- a comparing means 16 which compares between the added-up time $(Tf+Tb)$ calculated by the adding machine 14 and the standard cycle Tc set by the standard speed setting apparatus 12 in order to calculate a time difference Ts, where $Ts=Tc-(Tf+Tb)$, between them and send a signal to a time counter 17;
- the time counter 17 which measures stop time of the movable fire grates at the backward end A and issues a signal Pa to activate the movable fire grates 20 when the stop time reaches the time difference Ts as calculated by the comparing means 16; and,
- a grates activating apparatus 19 which receives the signal Pa and moves the fire grates 20 forward in response thereto.

Next, the method for speed-controlling with a stoker type burning apparatus according to the present invention is explained below.

Figure 5:
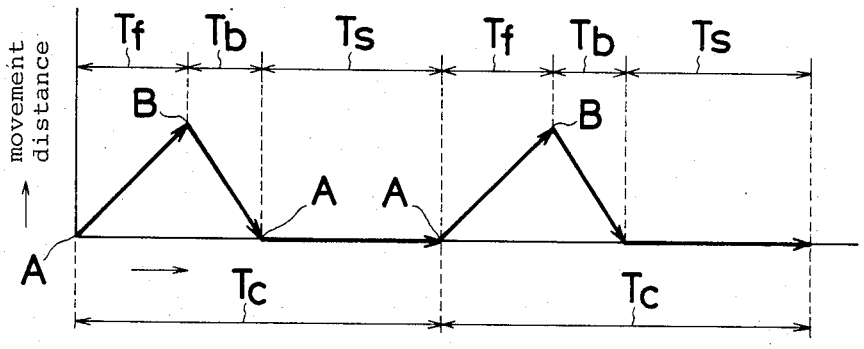

With reference to FIG. 5, the most appropriate flow velocity V(m/min.) of refuse on a stoker to be burned is determined, considering the quality of the refuse, the quantity of the refuse to be burned in a unit length of time and other things.

Next, the number N of cycles in a unit length of time (frequency) of the reciprocating motion of the fire grates 20 to achieve the above stated flow velocity V (m/min.) is determined. It is noted that the number N representative of frequency (cycles/min.) and the flow velocity of the refuse are in proportion, as stated above, that is, $V \alpha N$ i.e. $V=KN$. K is a fixed number and can be predetermined in accordance with the structure of the stoker, the quality of the refuse to be burned and other things.

The standard cycle time Tc needed for one reciprocating motion, that is, one cycle of the reciprocating motion is calculated on the basis of the number N of frequency (cycles per min.) of the reciprocating motion and is fed into the standard-speed setting apparatus 12.

Next, the time for forward movement of the movable fire grates (that is, the time Tf needed for the fire grates 20 to move from the backward end A to the forward end B) is measured by the time counter 13 and is fed into the time-adding machine 14. In the same manner, the time Tb needed to move from the forward end B to the backward end A is measured by the time counter 15 and this is fed into the time adding machine 14.

Time Tf for the forward movement and time Tb for the backward movement are added up by the time adding machine 14 and the added output thus gained is fed into the comparing means 16. The comparing means 16 compares between the standard cycle time Tc obtained from the standard speed setting machine 12, and the time $Tf+Tb$ obtained from the adding machine 14, and then feeds the output difference $Ts=Tc-(Tf+Tb)$ into the time counter 17.

On the other hand, the movable fire grates 20 are to be stopped at the backward end A by the grates-stopping apparatus 18 activated by a signal Ps transmitted from the time counter 15 or the time comparing means 16 when the movable fire grates 20 return to the backward end A from the forward end B. When counting by the time counter 17 reaches Ts, that is, the movable fire grates 20 have stopped for Ts, the movable fire grates 20 get started to again move forward under the control of the grates-activating apparatus 19 upon receipt of the signal Pa from the counter 17. In this manner, the movable fire grates 20 repeat the forward and backward movement in a predetermined standard cycle Tc.

The value of the standard cycle Tc is naturally adjusted in accordance with the quality of the refuse, the burning state thereof and other factors. This results in corresponding changes of the stop time Ts of the fire grates. Although the foregoing embodiment relates to a stoker comprising a combination of movable and fixed grates, the present invention can be employed on other types of stokers.

As stated above, one cycle of the reciprocating motion of movable fire grates of the present invention comprises forward movement, backward movement and a stop at the backward end A, while the stop time of the movable fire grates is adjusted, to thereby control the frequency N as measured in a unit length of time to control the velocity V of flow of refuse so that the velocity V equals a predetermined value. Consequently, the standard cycle Tc is controlled to set the predetermined value and thereby stabilize the flow speed of the refuse even if the speed of the reciprocating motion i.e. time $(Tf+Tb)$ for the forward and backward movement is changed due to "time wear" of the cylinder and other factors.

What is claimed is:

1. A velocity controlling apparatus to be used with stoker type burning apparatus on a refuse incinerator wherein refuse to be burned is moved forwardly by repeated reciprocating (forward and backward) motion of movable fire grates, said apparatus comprising:

a time counter measuring time Tf of forward movement of the movable fire grates;

a time counter measuring time Tb of backward movement of the movable fire grates;

a grates-stopping apparatus which stops the movable fire grates;

a time adding machine which adds up time Tf of forward movement of the movable fire grates and time Tb of the backward movement of the same;

a standard-speed setting apparatus which sets a standard cycle time Tc necessary for the movable fire grates to complete one cycle of the reciprocating motion, with the standard cycle time Tc being calculated on the basis of a predetermined frequency of the reciprocating motion of the fire grates;

a comparing apparatus which compares between the added-up time (Tf+Tb) and the standard cycle time Tc to calculate the time difference Ts between them;

a time counter which receives a signal representative of the time difference Ts and measures the stop time of the movable fire grates, said time counter issuing a signal Pa activating the movable fire grates when the stop time equals the said time difference Ts, and;

a grates-activating apparatus which receives the signal Pa and moves the movable fire grates to begin another cycle.

* * * * *